United States Patent [19]

Tan

[11] Patent Number: 4,777,866

[45] Date of Patent: Oct. 18, 1988

[54] VARIABLE DISPLACEMENT RADIAL PISTON PUMPS OR MOTORS

[75] Inventor: Ze-ying Tan, Nanjing, China

[73] Assignee: Nanjing Automobile Research Institute, China

[21] Appl. No.: 913,732

[22] Filed: Sep. 30, 1986

[51] Int. Cl.[4] ..... F01B 1/06

[52] U.S. Cl. ..... 91/488; 91/494; 91/497; 91/498; 92/12.1; 417/221

[58] Field of Search ..... 91/488, 494, 497, 498; 92/12.1, 58; 417/221

[56] References Cited

U.S. PATENT DOCUMENTS

| | | | |
|---|---|---|---|
| 1,906,787 | 5/1933 | Cuttat | 91/498 X |
| 2,473,271 | 6/1949 | Benedek | 91/498 X |
| 2,679,210 | 5/1954 | Muller | 92/58 |
| 3,131,604 | 5/1964 | Orshansky, Jr. | 91/497 X |
| 3,511,131 | 5/1970 | Kress | 91/472 X |
| 3,610,384 | 10/1971 | Borck | 415/89 X |
| 3,771,423 | 11/1973 | Culberson | 91/497 |
| 3,777,624 | 12/1973 | Dixon | 91/488 |
| 3,943,826 | 3/1976 | Kita | 91/488 |
| 4,362,480 | 12/1982 | Suzuki et al. | 418/178 X |
| 4,478,132 | 10/1984 | Braddock | 91/491 X |
| 4,503,754 | 3/1985 | Irwin | 91/488 |
| 4,635,535 | 1/1987 | Thoma et al. | 91/498 |

FOREIGN PATENT DOCUMENTS

| | | | |
|---|---|---|---|
| 82109988.4 | 10/1982 | European Pat. Off. | 91/472 |
| 978936 | 11/1950 | France | 92/12.1 |
| 1254200 | 1/1961 | France | 91/498 |
| 8010829 | 3/1980 | United Kingdom | 91/488 |

OTHER PUBLICATIONS

Design and Development of a Low Speed High Torque Hydraulic Motor by R. J. Recker (Society of Automotive Engineers, Inc., Publication No. 810974, copyright 1/1981).

Wheel Motors for Hydrostatic Mobile Equipment by Siegfried Nembach Zahnradfabrik Friedrichshafen AG (Society of Automotive Engineers, Inc., Publication No. 810971, copyright 1/1981).

Hydrostatic Assisting Drive by Claude Pinson (Society of Automotive Engineers, Inc., Publication No. 780756), 1/1981.

*Primary Examiner*—Carlton R. Croyle
*Assistant Examiner*—Paul F. Neils
*Attorney, Agent, or Firm*—Morgan & Finnegan

[57] ABSTRACT

This invention relates to a radial piston device with a rotatable casing useful as a pump or a motor. The device is highly efficient with an overall efficiency of 0.95 and a mechanical efficiency of 0.97, a wide rotational speed range of over 1000 rpm, and can be made with continuously variable or fixed displacement. The device is compact in size, light in weight and simple in structure making it easy to manufacture. Moreover, the device can be constructed from a variety of materials without restrictive material requirements, can operate with both filtered and non-filtered oil, and is not sensitive to environmental effects. When the device is mounted on a wheel to form a hydrostatic transmission system, the layout and performance of the vehicle are significantly improved. The displacement control means provided by the present invention is also applicable to other motors or pumps with eccentric shafts. This invention also provides a simple and reliable flat oil seal.

17 Claims, 17 Drawing Sheets

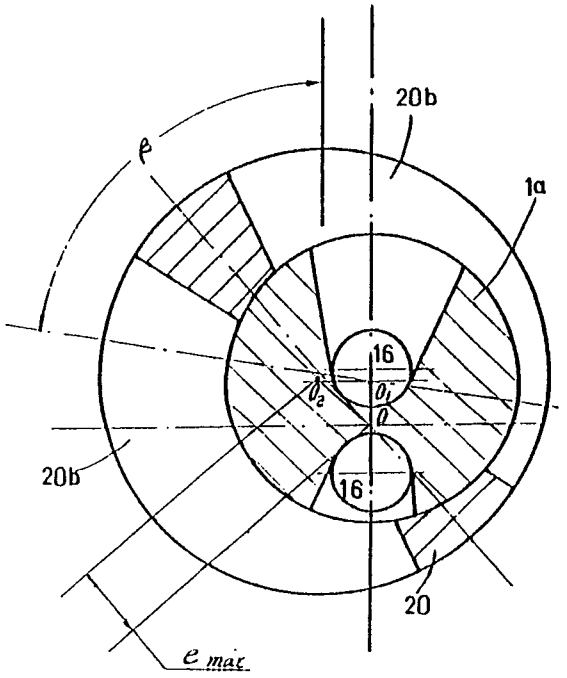
FIG.3d(i)
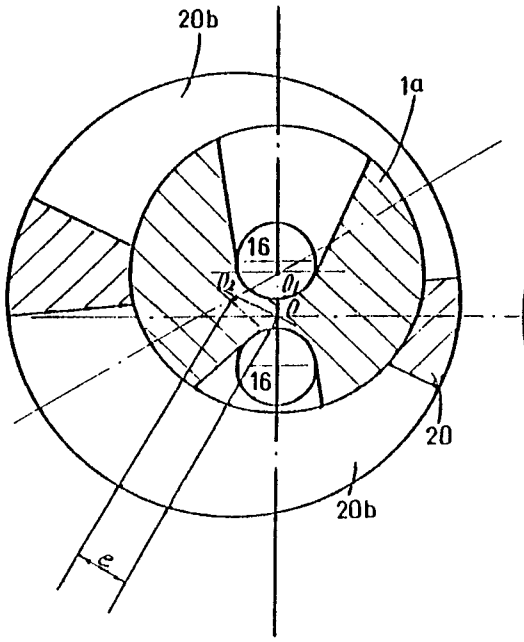
FIG.3d(ii)
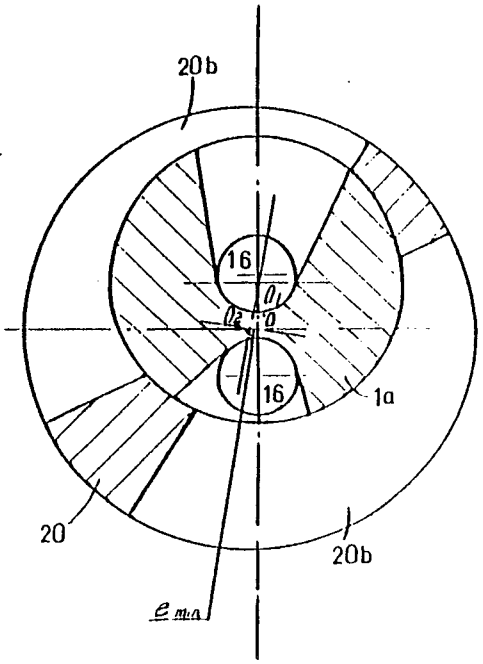
FIG.3d(iii)

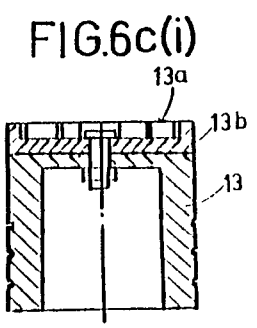
FIG.6c(i)
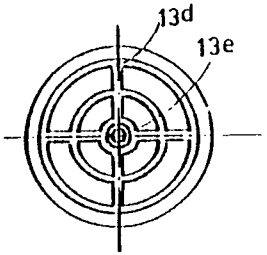
FIG.6c(ii)
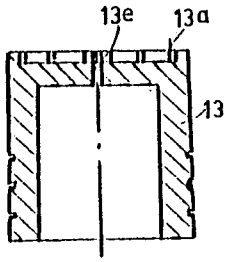
FIG.6b(i)
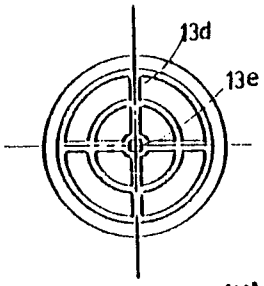
FIG.6b(ii)
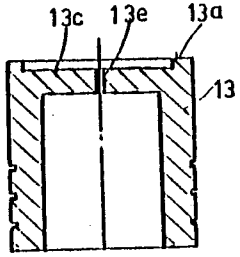
FIG.6a(i)
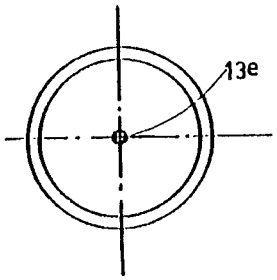
FIG.6a(ii)

II 11
1
III
3
2

1
C
E
13a
5a
5
5e
13
14a
11a
1a
2
III
1
26
11
II
E
I
3
4
4
7
11
7b
10
7a
C
I
1
11

VARIABLE DISPLACEMENT RADIAL PISTON PUMPS OR MOTORS

This invention relates to a radial piston device with a rotating case usable as a hydraulic pump or a hydraulic motor. The hydraulic fluid useful in a radial piston device according to the present invention may be an oil suitable for use in engines.

BACKGROUND OF INVENTION

Generally, a radial piston device usable as a motor or pump has the following elements: a circular casing with a bottom and a side wall and a top cover, which may be combined in one piece with the casing; an eccentric shaft journalled by bearings through the central part of the casing and the cover; a cylinder block, which may be machined in one piece with the casing, mounted directly on the eccentric shaft; the cylinder block having a number of cylinders, each fitted with a piston and radially arranged in the cylinder or block. During operation movement of the eccentric shaft drives the pistons to move reciprocatingly in the cylinders.

In this device, fluid or oil may be conducted via an oil duct, positioned in the eccentric shaft, and through oil distributing means to the space between the cylinders and pistons. With such an arrangement, when the pistons are driven to recirpocatingly move in the cylinders, the movement causes the intake and exhaust of fluid or oil, and the device is operated as a pump. However, when pressurized fluid or oil is transmitted from an outside fluid or oil source via the oil duct and oil distributing means to the spaces between the piston and cylinder, the pressure of the fluid or oil acting through the piston in combination with a connecting rod or acting directly upon the eccentric shaft produces a turning moment. If the eccentric shaft is fixed and stationary, a responding torque force causes the casing to rotate in the opposite direction. In such a case, the device is operated as a motor.

Many pumps and motors have been developed based on the above mentioned principles. One embodiment of such a radial piston device with a rotatable casing is described herein below.

On the eccentric of the eccentric shaft is rotatably fitted a star-like or pentagonal cylinder block with a plurality of hydraulic cylinders radially arranged in a plane perpendicular to the axis of the eccentric shaft. The block is enclosed with a circular casing having a bottom and a side wall with a plurality of planar surfaces evenly space around the inside of side wall and a top cover. Slidably fitted in each cylinder is a piston having a flat outer end engagingly held closely against the planar surfaces on the inside of the side wall of the casing by a coil spring or other resilient means. Arranged inside the eccentric shaft are two separate oil or fluid ducts for conducting a fluid into the cylinders.

During the operation of the device as a motor, one oil duct is connected to a high pressure fluid or oil source and the other to a low pressure fluid or oil source. In the center of the eccentric of the eccentric shaft there are two separate arcuate grooves each communicating respectively with one of the oil ducts in the eccentric shaft, so that the working fluid can be led to the cylinder and in turn act upon the casing through the piston. The resultant force exerted eccentrically on the casing produces a turning moment, and causes the casing to rotate.

Alternatively, if the device is connected to an external fluid source and the casing is driven by a power source, the planar surfaces on the inside of the casing cooperate with the action of the eccentric shaft to exert a force on the pistons causing them to move reciprocatingly in the cylinder. The reciprocating movement, with the aid of the oil ducts and oil distributing means results in the intake and exhaust of the fluid. The device is thus used as a pump.

The complete pump or motor is also fitted with oil leakage ducts, piston return springs, low friction bearings, thrust collars, sealing means, bolts etc.

Although the above-mentioned hydraulic pumps or motors have been gradually improved for many years, their structure and performance are still far from ideal. For most transmission systems, especially for the drive systems of vehicles, the working conditions such as, the required rotational speed and workload, vary over a wide range. However, a hydrostatic transmission system with a fixed displacement motor can only provide satisfactory performance over a narrow working range. Therefore, the application of hydrostatic transmission system is limited to low speed or low power rating systems and has not yet been used widely in vehicle drive systems, although it has many possible advantages; for example, the device may be provided with a completely continuously variable transmission or full automatic transmission with convenient layout. The reasons is that, until now, a simple and practical continuously variable displacement hydraulic motor has not been developed. Yet, to obtain high performance at most working conditions, the system must contain both a continuously variable displacement pump and a continuously variable displacement motor.

Moreover, the efficiency of a hydraulic pump and motor needs to be improved. In particular, the high efficiency area of these devices needs to be enlarged. Usually, a pump and motor now used only give high performance over a narrow range near its rated pressure and speed. If the working pressure and speed change over a wide range, the mean efficiency decreases significantly.

Furthermore, the rotational speed of a radial piston motor or pump needs to be increased. Generally, the working speed of a radial piston device ranges only up to about 200–300 rpm, its maximum speed being limited by mechanical factors and fluid mechanics. For instance, the mechanical efficiency of such a device decreases significantly with increasing rotational speed. Nevertheless, for most drive systems of vehicles and machines, the rotational speed required should be above 1000 rpm with widely varying working loads and working pressures. To obtain high efficiency over a wide range of working conditions, all of the factors which affect efficiency should be investigated thoroughly.

Additionally, cost is one of the key limitations to the practical application of a hydrostatic transmission system. This problem can be solved by simplifying the structure and technology, reducing the material requirements of hydraulic devices so that these become suitable for mass production.

To further broaden the applicability of such devices, the requirements for working fluid with specific properties and the need for filtration should not be strict. The device should be made less sensitive to load and temperature variations and vibration.

The best application for a radial piston device is as a wheel mounted motor for driving the wheel directly without need for additional speed change mechanisms. To accomplish this, the dimensions of the radial piston device, in particular its diameter, should be diminished and its weight reduced so that it can be conveniently mounted on the wheel and can withstand radial and axial shock load encountered while operating.

Based on the above considerations, the object of the present invention is to provide a hydraulic pump or motor which is simple in structure, with continuously variable displacement that is highly efficient over a wide rotational speed range.

Another object of the invention is to provide a hydraulic pump or motor having high mechanical and starting torque efficiencies by using hydrostatic support for the load sliding surfaces, thereby reducing friction losses.

Still another object of the invention is to provide a hydraulic pump or motor in which energy losses due to fluid flow in the oil ducts can be reduced, thereby enhancing the efficiency and maximum permissible working rotational speed.

A further object of the invention is to improve the volumetric efficiency of the radial piston device by optimizing the shapes and dimensions of its components to increase the flow resistance of the leakage fluid.

Another object of the invention is to provide a hydraulic pump or motor having good equilibrium performance with low PV ratings, i.e. pressure multiplied by velocity, for its load sliding surfaces under high speed and high pressure conditions.

Another object of the invention is to provide a hydraulic pump or motor, which can withstand heavy radial and axial loads, and which can be mounted directly on working components, such as a wheel, a sprocket, or a pulley. In this manner the transmission system of the machine, as a whole is further simplified.

Another object of the invention is to provide a wheel mounted motor which meets all of the above mentioned requirements. Using this type of wheel mounted motor as a part of a hydrostatic transmission system has many advantages and can replace transmission system presently used in many types of vehicles and machines.

A further object of the invention is to provide a low cost hydraulic pump or motor with simple structure and suitable for mass production.

SUMMARY OF THE INVENTION

To provide continuously variable displacement in an eccentric shaft type hydraulic pump or motor the fixed eccentric in the eccentric shaft is replaced by a combined eccentric of eccentric sleeve and eccentric shaft wherein the eccentric sleeve is rotatably fitted on the eccentric of the eccentric shaft. The combined eccentric continuously changes with the relative rotation of the eccentric sleeve to the eccentric shaft and thereby proportionally changes the stroke of the piston or the displacement of the pump or motor.

External control of the displacement of the relative angular position of the eccentric sleeve and the eccentric shaft is provided by using a combination of a slide pin, a displacement control sleeve and a displacement control arm.

To reduce mechanical friction losses and improve the mechanical efficiency of the pump or motor, pressurized oil is fed to load sliding surfaces to produce a hydrostatic supporting effect. Moreover, the layout of the pump or motor acording to the present invention is designed to further reduce frictional losses. In this layout, a major portion of the working torque, about 80–95%, is directly transmitted to the casing and the eccentric shaft by the pressurized fluid, with very small lateral forces acting upon the piston and the cylinder walls.

The present invention further provides means to force the leakage fluid stored in the casing out to a fluid reservoir to reduce torque losses caused by relative movement between the casing and the cylinder block. A spoon-like oil duct, with an inner and outer end, is arranged in the pump or motor. The inner end is connected to a leakage oil duct in the eccentric shaft and the outer end is radially extended as far as possible, so that when the casing rotates, the dynamic pressure and inertia of the fluid or oil stored in the casing force the fluid, by means of the spoon-like oil duct, through the leakage oil duct to an outside fluid reservoir. The removal of fluid stored in the casing reduces energy losses caused by disturbances of fluid flow within the casing.

The present invention also provides oil ducts with larger cross sectional areas to decrease localized flow resistance at corners and reduce frictional losses due to fluid flow. Hydraulic losses due to fluid flow are sometimes larger than mechanical friction losses at high speeds. Thus, any improvements in hydraulic losses can increase significantly the high efficiency working area of a radial piston device and the maximum permissible working speed.

According to the present invention, the volumetric efficiency is improved and hydraulic losses are reduced by using cylinders with a step-shaped axial section, i.e. each cylinder has an outer portion with a larger diameter bore and an inner portion with a smaller diameter bore, with the smaller diameter portion positioned toward the center of the cylinder block. The bore of the portion with a smaller diameter is further modified to an oval shaped cross section to increase sealing width. Moreover, volumetric efficiency is improved by selecting an appropriate hydraulic supporting force between the cylinder block and the eccentric shaft or eccentric sleeve so that the force pushing the cylinder block against the eccentric shaft or eccentric sleeve is somewhat larger than the force which lifts the cylinder block from the eccentric shaft or eccentric sleeve. In this manner, the cylinder block is kept in constant contact with the eccentric shaft or eccentric sleeve on the high pressure side. Thus, the mean leakage clearance between the cylinder block and the eccentric shaft or eccentric sleeve is reduced to a minimum and the volumetric efficiency becomes insensitive to the leakage clearance.

For good equilibrium performance and ease of manufacture, the main turning components, such as the casing, the cover and the cylinder block are simple in form with good fit.

The PV rating of the main load sliding surfaces is reduced by feeding pressurized oil therebetween to provide hydrostatic support which reduces the mean contact pressure between these surfaces.

According to this invention, the rotating casing and cover have a very strong structure and are supported by large capacity bearings, so heavy radial and axial loads can be sustained, making it useful for a wheel mounted motor.

The hydraulic motor according to the present invention is very compact in size, and can be directly mounted on a wheel. Further, the oil seal cover of the hydraulic motor is extended to form a disk or drum for mounting an additional brake.

The present invention also provides a fixed displacement hydraulic pump or motor wherein the eccentric of the eccentric shaft is fixed and the eccentric sleeve, sliding pin, displacement control sleeve and displacement control arm are eliminated.

Since the hydraulic device according to the present invention, when used as a pump is identical in construction to the device when used as a motor, with simple components and structure, and flexible material requirements, it is suitable for mass production. The cost of manufacturing can thereby be reduced.

The reliability and life of the oil seal is improved by the use of a simple compact face oil seal having only two parts to sustain oil pressure.

BRIEF DESCRIPTION OF THE DRAWINGS

For the description of the invention, the accompanying drawings are provided. They are intended to serve only as examples; the invention is not limited to the drawings.

FIGS. 1-*a*, -*b* and -*c* show different embodiments of the spoon-like oil duct taken from FIG. 1 along line F—F, in which FIG. 1-*a* is for a one-direction rotating motor or pump, FIG. 1-*c* is for a bidirectional rotating motor or pump, and FIG. 1-*b* is an alternate embodiment of the duct.

FIGS. 3-$d_1$ -$d_2$ and -$d_3$ show the relative positions of the oil duct within the eccentric shaft and eccentric sleeve at different combined eccentrics.

FIGS. 6-*a*, -*b*, and -*c* show three piston structures according to the present invention.

FIGS. 15-*a*, -*b*, -*c* show different embodiments of the spoon-like oil duct taken from FIG. 15 along line E—E, in which FIG. 15-*a* is for a bidirectionally rotating motor or pump, FIG. 15-*c* is for a one-directional rotating pump, and FIG. 15-*b* shows an alternate embodiment of the spoon-like oil duct.

FIGS. 15-*d*, -*e*, and -*f* show enlargements of elements of the fixed displacement pump or motor.

FIG. 17 shows a new type of face oil seal according to the invention.

DETAILED DESCRIPTION OF THE INVENTION

In order to promote a fuller understanding of the above and other aspects of the present invention, the embodiments will now be described, by way of example only, with reference to the accompanying drawings.

Figure 1:
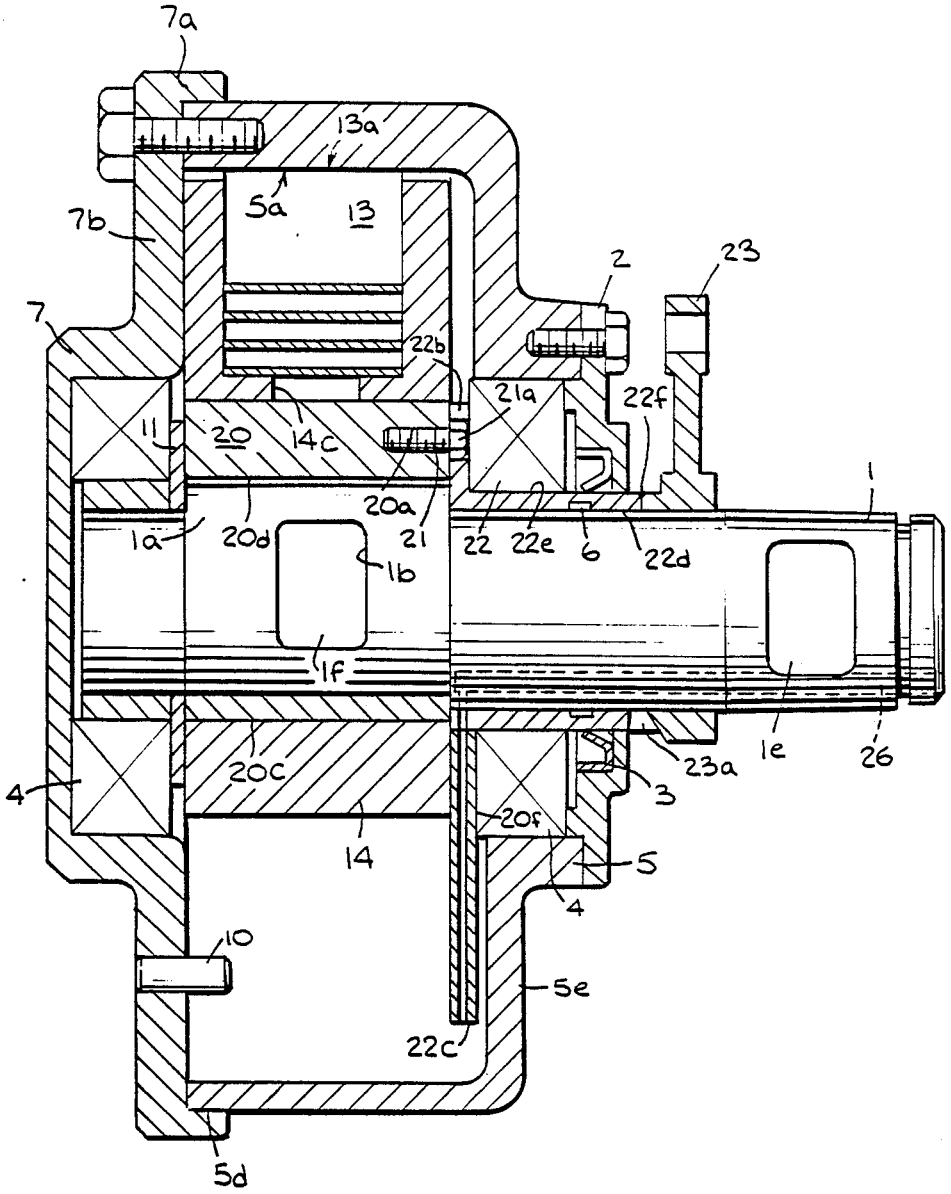
FIG. 1 is an axial section of a continuously variable displacement pump or motor embodying the invention.
Figures 1A, 1B, 1C:
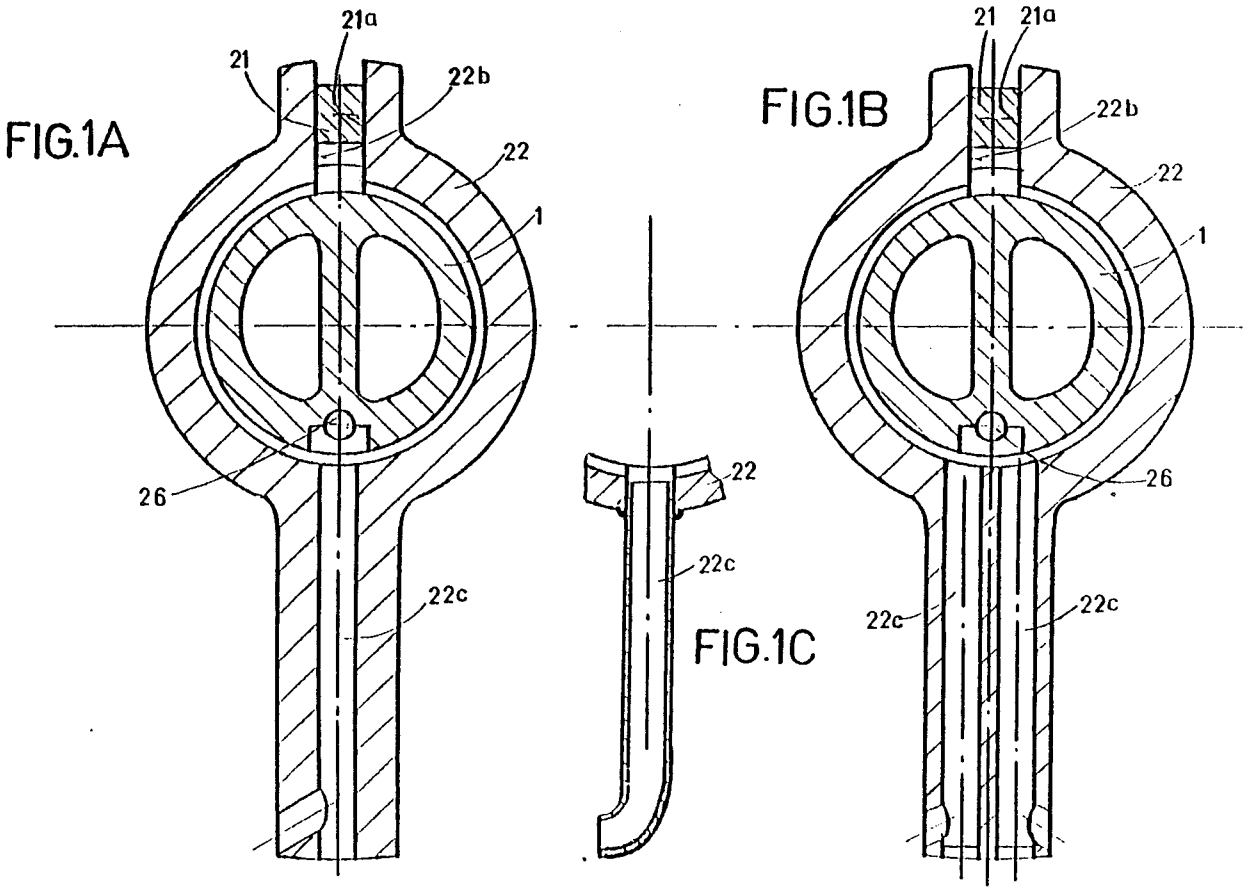
Figure 2:
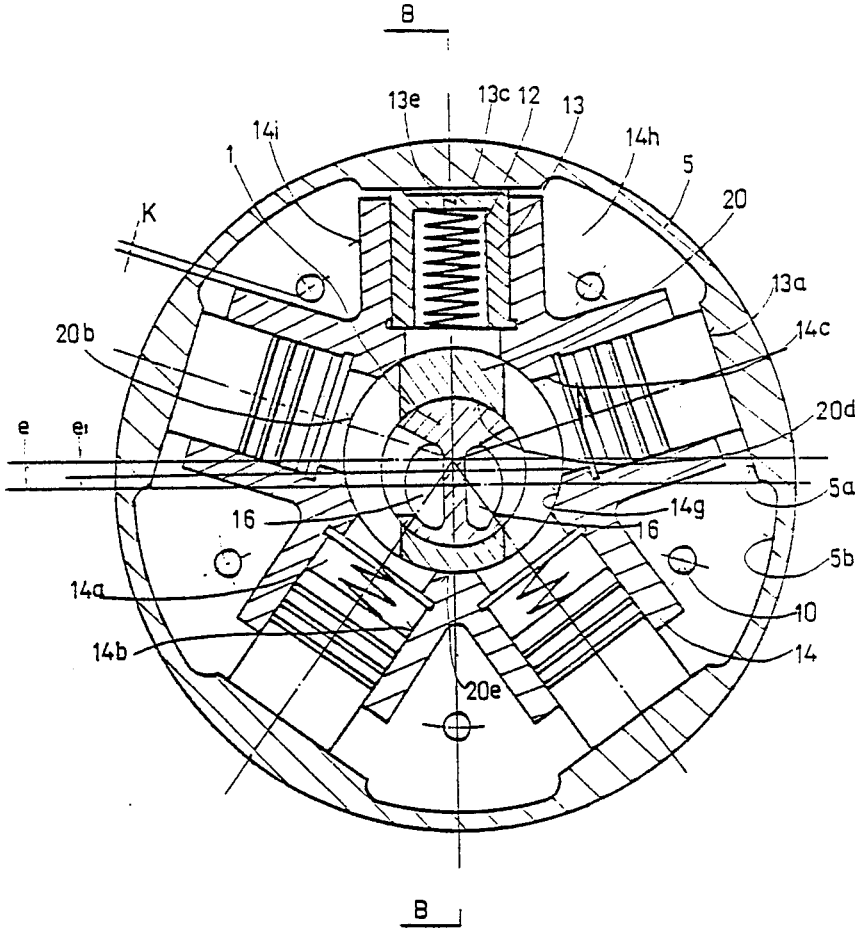
FIG. 2 is a cross section taken from FIG. 1 along lines A—A.

A continuously variable displacement hydraulic device, illustrated in FIGS. 1 and 2, comprises a circular casing (5), with a side wall having a plurality of planar surfaces on the inner side wall, a cover (7) therefor, the central part of the casing (5) and the cover (7) being fitted with bearings to support an eccentric shaft (1) having an eccentric (1*a*) between the bearings (4); an eccentric sleeve 20 rotatably mounted on the eccentric (1*a*) with a bore (20*d*) disposed eccentrically and parallel to the outer periphery (20*e*) of the eccentric sleeve (20); the relative angular position of the eccentric sleeve (20) to the eccentric shaft (1) being controlled by an adjusting mechanism, for continuous adjustment of the combined eccentric (e) and thereby the displacement of the pump or motor; a star-like cylinder block (14) rotatably mounted on the outer periphery (20*e*) of the eccentric sleeve (20), the cylinder block (14) having a plurality of hydraulic cylinders (14*a*) radially arranged in a plane perpendicular to the axis of the eccentric sleeve (20) and the eccentric shaft (1); a sliding piston (13), having an outer flat end face (13*a*) contacting a planar surface (5*a*) on the inner side wall of the casing (5), slidably fitted into each of the cylinders (14*a*); a return spring (12) positioned between the piston (13) and the cylinder block (14) forcing the piston against the planar surface (5*a*) on the inner side wall of the casing (5); two separated groups of oil ducts (16) arranged in the eccentric shaft (1), one group of oil ducts being connected to a high pressure fluid or oil system and the other to a low pressure fluid or oil system; two separated arcuate oil distributing grooves (20*b*) in the eccentric sleeve (20) communicating respectively with the oil ducts (16) in the eccentric shaft (1) and in cooperation with oil duct distributing means (14*c*) in the cylinder block whereby pressurized fluid is introduced to the cylinder (14*a*) in turn.

The hydraulic radial piston device above mentioned is especially suitable for a rotable casing (5) and a stationary eccentric shaft (1). When the casing (5) is driven by an engine or another motor, the action of the combined eccentric (e) causes the piston (13) to run reciprocatingly in the cylinder (14*a*). The movement in cooperation with the action of the oil distributing groove (20*b*) results in the intake and exhaust process needed for pumping action.

When pressurized fluid is transmitted via one group of oil ducts (16) in the eccentric shaft (1) and the eccentric sleeve (20) to the pistons (13) (generally, the number of pistons (13) is $2n+1$, so the pressurized oil communicates alternatively with n or $n+1$ pistons and cylinders during operation), it forces the latter outwardly toward the casing (5), thereby exerting a force on the planar sufaces (5*a*) of the casing (5), most of which is being transmitted directly by the pressurized fluid or oil, with the remaining force by the pistons (13). The resultant force exerted on the casing (5) is eccentric and produces a turning moment for rotating the casing. In this manner, the device is used as a motor.

To adjust the combined eccentric (e), or control the displacement of the device externally, a sliding pin (21) is slidably mounted in a sliding pin hole (20*a*) positioned in the side face (20*f*) of the eccentric sleeve (20); the sliding pin (21) having two slide planes (21*a*) on the outside thereof and extending to a slide groove (22*b*) in a displacement control sleeve (22) having face (or outer) teeth (22*f*) slidably and rotably mounted on the eccentric shaft (1), the outer periphery (22*e*) of the displacement control sleeve (22) being pressed into the inner ring of the bearing (4) with a light pressure fit, and the face teeth (22*f*) thereon connected with a displacement control arm (23) coaxially mounted on the eccentric shaft (1), the displacement control arm (23) having face inner teeth (23*a*) engaging the teeth of the displacement control sleeve (22) and connecting means such as a connecting ball or pin or teeth for connecting to a control means external to of the radial piston device. When sufficient torque is applied to the displacement control sleeve (22), it will be rotated relative to the eccentric shaft (1). This movement is further transmitted to the eccentric sleeve (20) via slide groove (22*b*) and slide pin (21) and urges the eccentric sleeve (20) to produce a rotary movement relative to the eccentric (1*a*), thereby adjusting the combined eccentric (e) continuously.

Figure 3A:
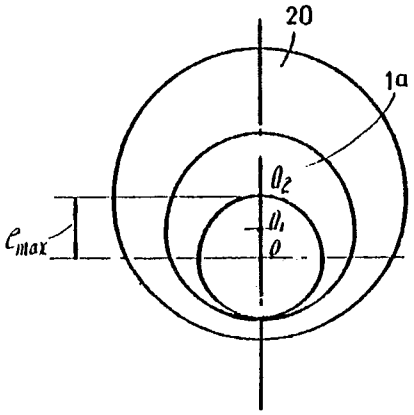
FIGS. 3-*a*, -*b*–*c* show the formation of the combined eccentric (e) and how the eccentric changes in different positions.
Figure 3B:
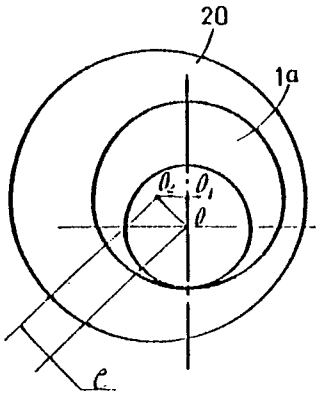
Figure 3C:
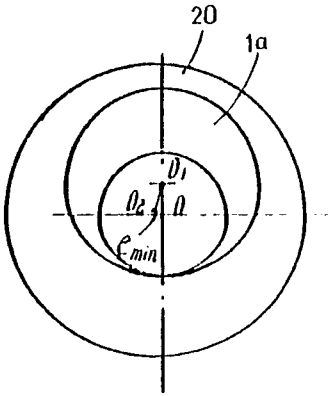

FIG. 3 shows the varying form of the combined eccentric (e). "O" represents the center of the eccentric shaft (1), the casing (5) and/or cover (7), $O_1$ represents the center of the eccentric (1*a*) and $O_2$ represents the center of the outer periphery of the eccentric sleeve (20). At the position illustrated in FIG. 3-*a*, the vector distance between the centers of the eccentric (1*a*) and the eccentric shaft (1), shown as $OO_1$ is aligned with the vector distance between the eccentric (1*a*) and the eccentric sleeve (20), as represented by $O_1O_2$. Thus, the combined eccentric ($e_{max}$) equals $OO_1+O_1O_2$. At the position illustrated in FIG. 3-*b*, the eccentric sleeve (20) is rotated counterclockwise until vector $O_1O_2$ is perpendicular to $OO_1$. In this case the combined eccentric (e) is the vector sum of $OO_1$ and $O_1O_2$. At the position illustrated in FIG. 3-*c*, the vector $OO_1$ is nearly opposite to vector $O_1O_2$, and the combined eccentric ($e_{min}$), namely the vector sum of $OO_1$ and $O_1O_2$ is at its minimum. The value of $O_1O_2$ and $OO_1$ can be identical or different as desired. Because the relative position of the eccentric sleeve and the eccentric shaft may be varied, the combined eccentric may be varied continuously.

In practice, for the arrangement of the oil duct (16) within the eccentric shaft (1), and the eccentric sleeve (20), the eccentric sleeve (20) is arranged with an initial angle B which usually ranges from 60°–150°, as FIG. 3-*d* shows.

FIG. 3-*d* also shows the relative positions of the oil duct within the eccentric shaft (1*a*) and the eccentric sleeve (20) at different combined eccentrics. It is clear that the fluid can flow from oil duct (16) via distributing groove (20*b*) and oil duct (14*c*) into the chamber of the cylinder (14*a*) at any combined eccentric.

The continuously variable displacement control means above stated can also be used in other types of radial piston pumps or motors which use an eccentric shaft to create the turning moment, especially in motors or pumps with a rotating casing, such as those sold under the trademarks STAFFA, RUSTON, or CALZONI.

Figure 4A:
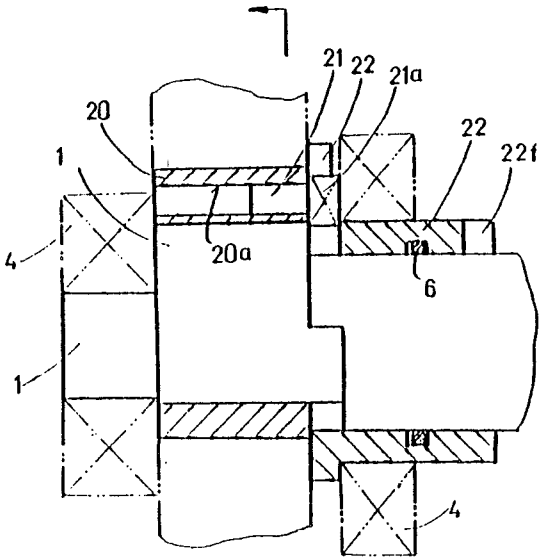
FIGS. 4-*a* and 4-*b* shows the displacement control means of the present invention.
Figure 4B:
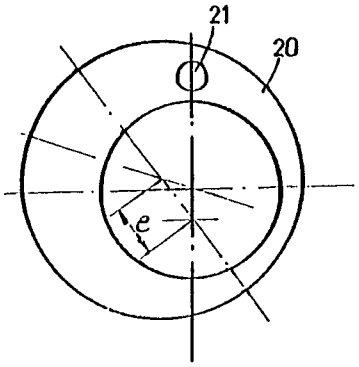

As shown in FIGS. 4-*a* and 4-*b* the eccentric shaft of the present invention is separated into two components, namely the eccentric sleeve (20) and the eccentric shaft (1). If the fixed eccentric of these motors or pumps is replaced by a combined eccentric (e), the displacement of these motors or pumps can also be continuously controlled by a combination slide pin (21), displacement control sleeve (22) and displacement control arm.

Further improvements include a leakage oil duct (26) arranged in the eccentric shaft to permit draining the leakage oil stored in the casing (5); an oil seal (3) positioned at the exit end of the eccentric shaft (1); an O-ring (6) positioned between displacement control sleeve (22) and the eccentric shaft (1) as sealing means to guarantee the integrity of the pump or motor; and a thrust washer (11) positioned on the side of the cylinder block (14) to limit its axial movement.

The present invention is designed to improve the main factors which influence mechanical and volumetric efficiency of the hydraulic pump or motor.

Generally, mechanical losses (or torque losses) in radial piston devices originate from friction losses on the sliding surfaces and fluid flow resistance, with most of the friction losses occurring between the pistons (13) and their related contact surfaces as well as in the fluid distributing means.

Figure 5A:
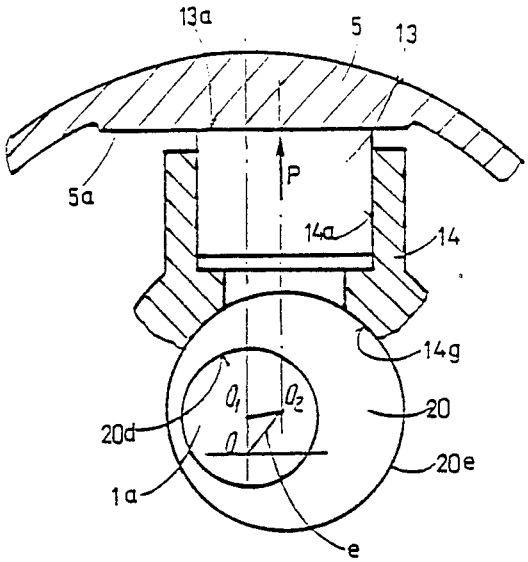
FIGS. 5-*a* and -*b* shows the interaction between the casing, piston and the cylinder block.
Figure 5B:
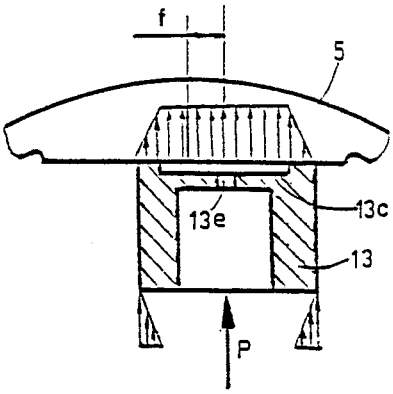
Figure 7A:
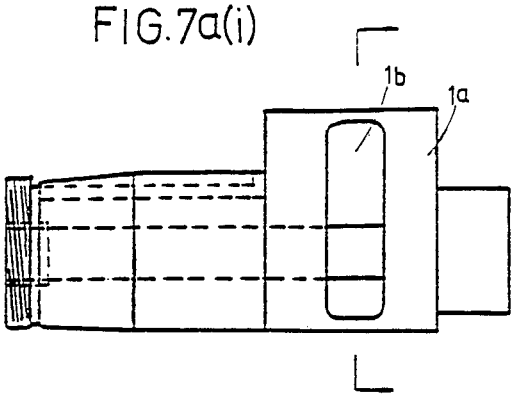
FIGS. 7-*a*, -*b*, and -*c* show three structures for the eccentric shaft according to the present invention.
Figure 7A:
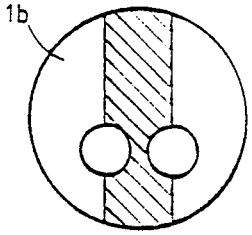
Figure 7B:
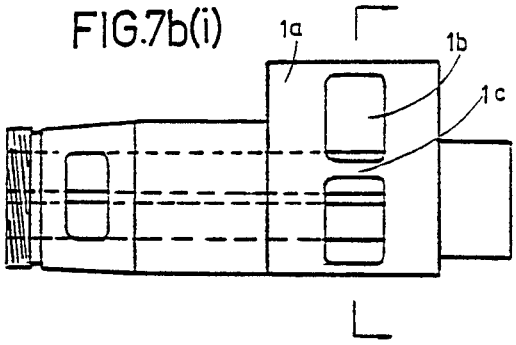
Figure 7B:
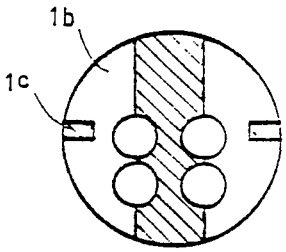
Figure 7C:
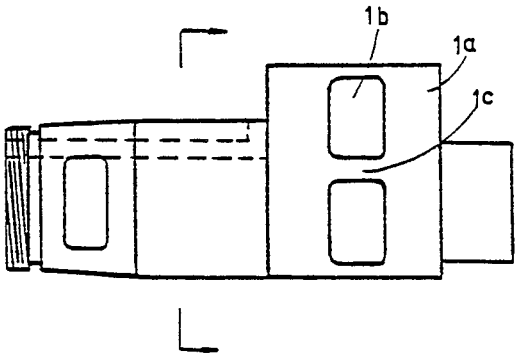
Figure 7C:
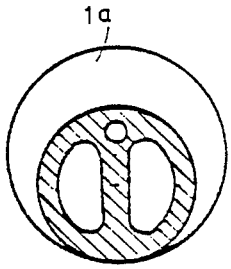

As FIG. 5-*a* shows, the cylinder block is rotatably mounted on the eccentric sleeve (20) and can be rotated relative to the casing (5). When a piston (13) is forced against the casing (5) side wall by a pressurized fluid, the flat end face (13*a*) of the piston is held in close contact with a planar surface (5*a*) on the inner side wall of the casing (5). The movement of the piston causes the cylinder block (14) to rotate until the axis of the cylinder (14*a*) is perpendicular to the planar surface (5*a*) of the casing (5), and thrust is transmitted only along its vertical axis. FIG. 5-*b* shows the forces interacting between the piston (13) and the casing (5). For simplicity, only one piston (13) is shown. The effect of the remainder of the pistons (13) communicating with the pressurized fluid is similar. The only difference is that force arm (f) varies with the position of each piston. So that the torque force acting on the casing (5) is equal to the algebraic sum of the torque forces produced by the individual pistons In FIG. 5-*a*, letter O represents the turning center of the casing (5) and/or the cover (7). $O_1$ represents the center of the eccentric (1*a*) of the eccentric shaft (1), namely, the center of the inner hole (20*d*) of the eccentric sleeve (20), $O_2$ represents the center of the outer periphery (20*e*) of the eccentric sleeve (20), namely, the center of the inner bore (14*g*) of the cylinder block (14), $OO_2$ represents the combined eccentric (e). Because the axes of all cylinders or pistons (13) pass through the center $O_2$ of the cylinder block 14 are arranged radially, the resultant forces P acting on the pistons (13) will also pass through the center $O_2$ along each of the axis perpendicular to the planar surface (5*a*) of the casing (5). Under such circumstances, the resultant force P produces a turning movement pf around Point O (letter f represents the arm of force of the resultant force P to point O) to act on the casing (5), and causes it to rotate counter-clockwise around its center O.

Obviously, in this layout of the radial piston device of the present invention, the turning torque of the casing (5) is caused by an offset of the piston (13) relative to the casing (5). Since the piston (13) will only transmit thrust force along its axis, no lateral forces are exerted. In this manner, one of the main factors for friction losses in radial piston devices is avoided.

To further reduce the friction losses between the pistons (13) and the planar surfaces (5*a*) on the inside wall of the casing (5), hydrostatic supporting means are applied.

A fluid recess (13*c*) is arranged coaxially in the end face (13*a*) of the piston (13) communicating with the working oil duct through a throttle hole (13*e*). Thus, most of the thrust force transmitted originally by the pistons (13), as shown in FIG. 5-*b* by the trapezoid area, will be directly transmitted by pressurized fluid. Only a minor portion, represented by triangles in FIG. 5-*b* will still be transmitted through the piston (13) to the casing (5). Generally, this minor portion of the thrust transmitted by the pistons is controlled to about 5–20% of the total, so that frictional losses between the piston (13) and the casing (5) can be reduced by about 80–95%. The fluid recess (13*c*) can also be made in reticular form, as shown in FIGS. 6-*b* and 6-*c* to further reduce contact pressure between the piston (13) and the planar surface (5*a*) of the casing (5) and hence improve the wear-resistance of the end faces (13*a*) of the pistons (13) and the planar surfaces (5*a*) of the casing (5).

Reduction of friction losses between the piston (13) and the planar surface (5*a*) on the inner side wall of the casing (5) to increase its working life is provided by a friction reducing layer on the end face (13*a*) of the piston (13) or provided by a piston head (13*b*) made from friction reducing material. For example, FIG. 6-*a*, 6-*b* and 6-*c* show three types of structure for a piston according to the present invention. Friction loss due to relative rotation between the cylinder block (14) and the eccentric sleeve (20), can also be reduced by hydrostatic supporting means.

Further, as shown by test results, the principal mechanical losses in a high speed radial piston device are due to resistance to fluid flow in the oil ducts and disturbances in fluid flow produced by the relative movement of the cylinder block (14) to the casing (5). These two sources of mechanical losses increase parabolically with the rotational speed and limits the permissible maximum working speed of the device.

To increase the working speed range, according to the present invention, the leakage fluid stored in the casing (5) is forced out to reduce the contact area between the fluid and the cylinder block (14) to thereby reduce the resistance, or torque losses from disturbances in fluid flow. One end of a spoon-like oil duct (22*c*) is arranged on the displacement control sleeve (22) to communicate with the leakage oil duct (26) in the eccentric shaft (1). The other end of the spoon-like oil duct is extended radially as far as possible to use the dynamic pressure and the inertia of the leakage fluid stored in the rotating casing to force the leakage fluid out to an outer fluid reservoir via the spoon-like oil duct (22*c*) and leakage oil duct 26 in the eccentric shaft (1). In this manner, disturbances of oil flow at high speeds can be reduced.

Resistance to fluid flow in the oil duct is also reduced by enlarging the cross sectional area of the oil duct. FIG. 7 shows three structural forms for oil ducts in the eccentric shaft (1).

FIG. 7-*a* shows two oil ducts each having a cylindrical hole. This form of oil duct is simple in structure and easy to manufacture. However, its cross sectional area is limited, and has been found to be suitable only for devices with low to medium rotational speeds.

FIG. 7-*b* shows two paired oil ducts, each having a cylindrical hole, wherein each pair of holes located on the same side of the eccentric shaft communicates with each other at the entrance and exit. Thus, the total cross sectional areas of the paired oil ducts are larger than that of a single duct in FIG. 7-*a*.

FIG. 7-*c* shows two oil ducts with kidney-shaped cross sections. In this case, the cross sectional areas of the oil ducts are enlarged maximally. Moreover, an ideal curve is created at the place of turning and resistance to fluid flow is reduced to a minimum. This cross sectional shape for the oil ducts is specially suitable for radial piston devices with desired high speed and high rating. Moreover, by modifying the cross section of the lower portion (14*c*) in the cylinder block (14) to an oval further reduction in resistance to fluid flow is achieved.

In the above mentioned embodiment, the main factor influencing volumetric efficiency is the leakage of pressurized fluid through the clearances to the inner space of the casing (5) or directly to the low pressure oil duct. The leakage takes place in four parts: namely, between the end faces (13*a*) of the pistons (13) and the planar surfaces (5*a*) of the casing (5); between the pistons (13) and the cylinders (14*a*); between the inner bore (20*d*) of the eccentric sleeve (20) and the eccentric (1*a*) of eccentric shaft (1); and between the eccentric sleeve (20) and the inner bore (14*g*) of the cylinder block (14). As known from fluid mechanics, the amount of fluid leakage through a clearance is directly proportional to the fluid oil pressure and the cube of the height of the clearance and inversely proportional to width of the clearance. Therefore, the best way to reduce the leakage is to decrease the leakage clearance and the next best is to increase its width.

Figures 8A, 8B, 8C:
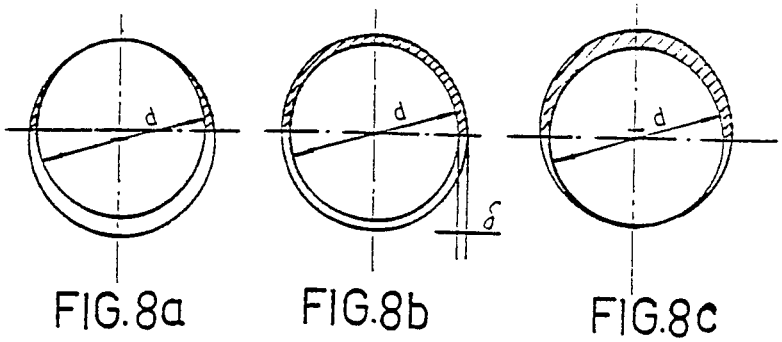
FIGS. 8-*a*, -*b* and -*c* show the variations of leakage clearance and the cross sectional areas of the bore and the shaft arranged in different relative positions.

FIG. 8 shows the variations of leakage clearance and its cross sectional area with variations in position of the bore and shaft, wherein the diameter of the shaft is d and clearance is $2\delta$.

FIG. 8-*b* shows the case in which the bore and shaft is arranged concentrically, the cross sectional area (shaded) of the leakage clearance, equals to $\frac{1}{2}\pi d\delta$. FIG. 8-*a* shows the case in which the shaft contact the bore at the high pressure side. The area of the leakage clearance is reduced to its minimum and equals $\frac{1}{2}\pi d\delta - d\delta = (\pi/2 - 1)d\delta$. FIG. 8-*c* represents the case in which the shaft contacts the bore at the low pressure side. Under such circumstances, the cross sectional area of the leakage clearance is at its maximum and is equal to $\frac{1}{2}\pi d\delta + d\delta = (\pi/2 + 1)d\delta$.

The ratio of fluid leakage in the three cases above mentioned is 1:0.364:1.63. Furthermore, because the amount of fluid leakage is proportioned to the cube of the height of the clearance, the ratio of the amount of fluid leakage in the three cases is about 1:0.048:4.32. In other words, the amount of fluid leakage in the case represented in FIG. 8-*a* is only about 1/20 of the case represented in FIG. 8-*b* and about 1/90 of the case represented in FIG. 8-*c*. Therefore, keeping the cylinder block (14) in contact with the eccentric sleeve (20) at the high pressure side is an effective means for improving the volumetric efficiency of the radial piston device.

Figure 9:
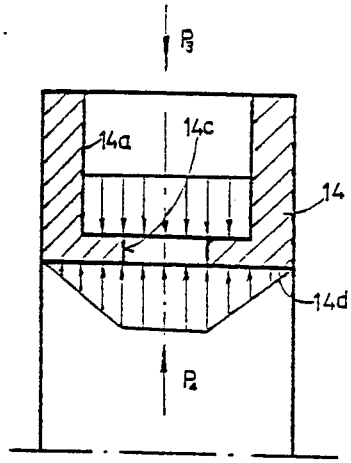
FIG. 9 shows the forces acting on the cylinder block during operation.

FIG. 9 illustrates the forces acting on the cylinder block (14) during operation of the radial piston device. According to the above mentioned principle, the structure and dimension of the cylinder block should be selected in such a way that the resultant force $P_3$ of the pressurized oil pushing the cylinder block (14) toward the eccentric sleeve (20) is somewhat larger than the resultant force $P_4$ of the pressurized oil acting on the inner bore (14*g*) of the cylinder block (14) to force it to be lifted from the eccentric sleeve (20). In this way, the cross sectional area of the leakage clearance is reduced to a minimum and volumetric efficiency is significantly improved.

Figure 10B:
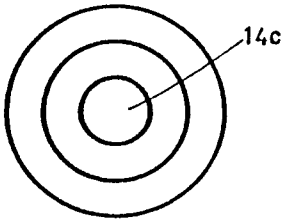
FIGS. 10-*a*, -*b*, and -*c* show the cylinder form and the cross section of the distributing means in the cylinder block.
Figure 10C:
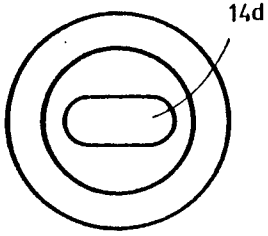
Figure 10A:
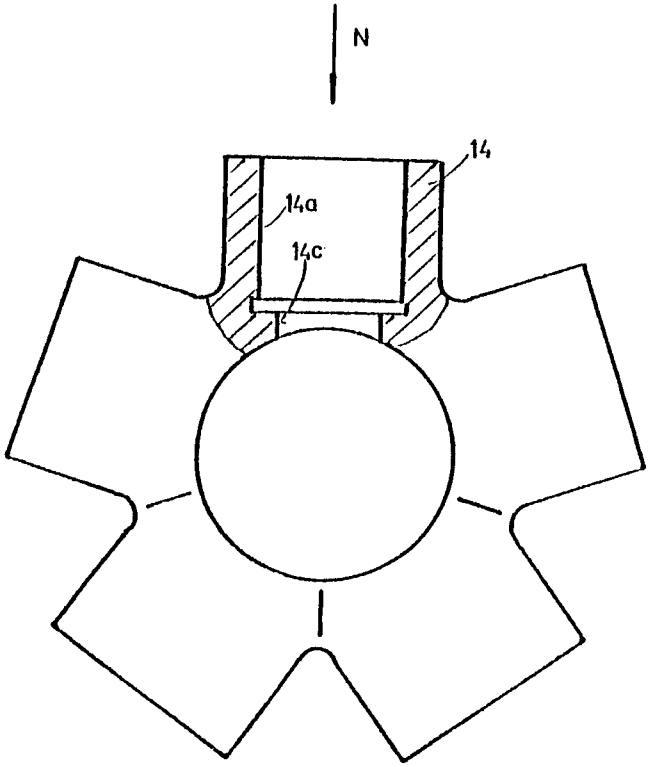
Figure 11C:
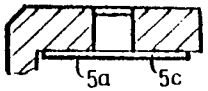
FIGS. 11-*a*, -*b*, -*c*, and -*d* show various sections of the integral construction of the casing for improving wear resistance.
Figure 11D:
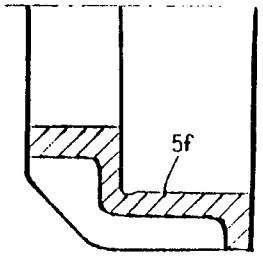
Figure 11B:
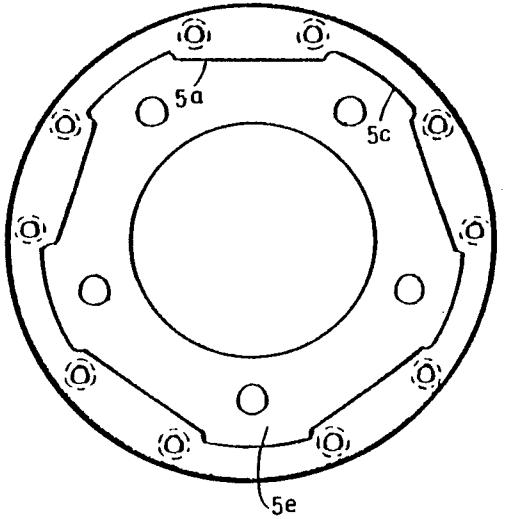
Figure 11A:
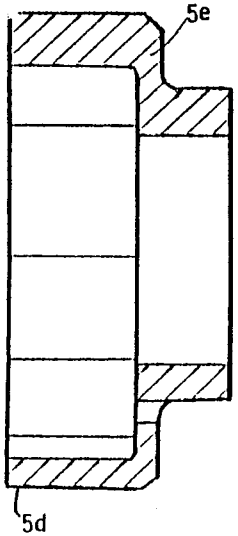
Figure 12A:
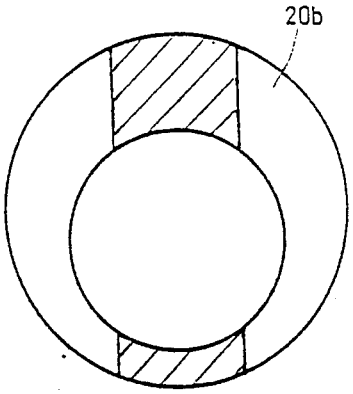
FIGS. 12*a, b,* and *c* show three different shapes for the distributing grooves on the eccentric sleeve.
Figure 12A:
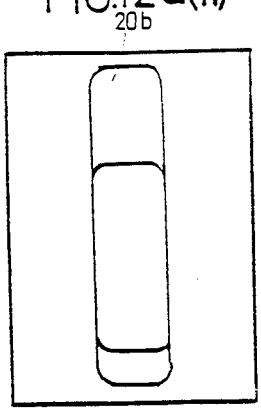
Figure 12B:
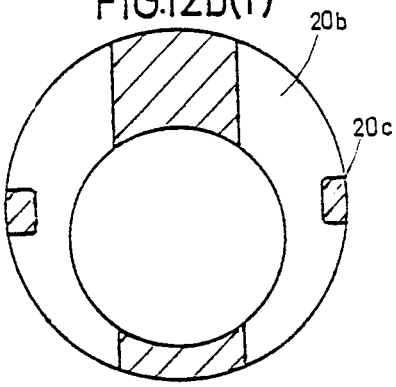
Figure 12B:
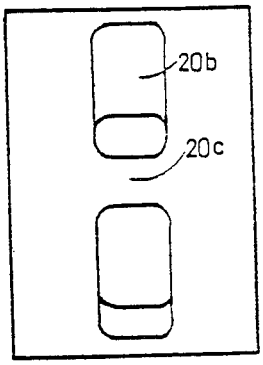
Figure 12C:
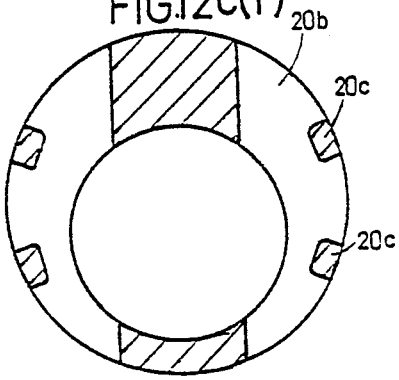
Figure 12C:
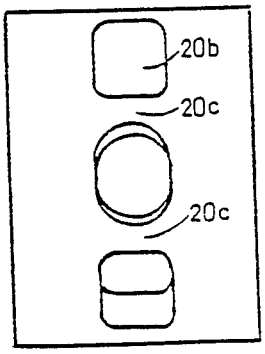

The volumetric efficiency of the radial piston device may further be improved by increasing the seal width. The cylinder bore (14*a*) of the cylinder block (14) is arranged in stepped form, namely, with an inner portion having a smaller diameter (14*c*) toward the center of the cylinder block as shown in FIG. 10. FIG. 10-*c* shows an oval cross sectional shape for the bore of the inner smaller diameter portion. This increases the seal width and its cross sectional area thereby improving both the volumetric efficiency and mechanical efficiency.

Under working conditions, the cylinder block (14) is kept in step with the casing (5) by an overturning moment acting on the piston 13. The amount of the overturning moment is determined by the frictional moment between the cylinder block (14) and the eccentric sleeve (20) as well as by the inertia of the cylinder block (14). The overturning moment is produced and limited by the redistribution of the contact force between the piston (13) and the planar surface (5*a*) on the inner side wall of the casing (5), obviously when the overturning moment required for driving the cylinder block (14) exceeds the limit, the cylinder block (14) will be slower than the casing (5). In this case, the piston (13) would move from the planar surface (5*a*) on the inner side wall of the casing to the arcuate section (5*b*) in the inner surface of the casing (5) and the normal working process could not be continued. To prevent the occurrence of this phenomenon, safety pins (10) pressed into the side wall of the casing (5) or the cover (7) are provided with the outer ends (10*a*) of the safety pins (10), extending into the vacant spaces (14*h*) between adjacent cylinders. The safety pins (10) have an appropriate clearance to the cylinder wall (14*i*) to allow the cylinder block (14) to rotate slightly relative to the casing (5) even while at maximum displacement when the piston (13) moves along the planar surface (5*a*) on the inner side wall of the casing (5) to an extreme position. However, when the relative rotating speed between the casing (5) and the cylinder block (14) changes suddenly, the safety pins (10) will contact the cylinder wall (14*i*) and limit the amplitude of the relative rotating movement. By this means, the piston (13) can be held in position and prevented from moving to the arcuate section (5*b*). With the disappearance of the sudden change the piston (13) will return to its normal position, and the correct working of the radial piston device is guaranteed.

Under the action of the pressurized oil, the main load carrying components of the radial piston device may be deformed. If the deformation is not controlled appropriately, there will be additional friction losses as well as dramatic increase of fluid leakage. To solve this problem measures are taken to increase the rigidity of the key components.

For example, the casing (5) suffers a large radial thrust force from the piston (13) and the pressurized fluid. Significant deformation caused by this force can destroy the close contact necessary between the piston (13) and the planar surface (5*a*) on the inner side wall of the casing (5). To minimize this deformation an integrally constructed casing (5), as shown in FIG. 11 with a strong side wall (5*e*) is used to increase its rigidity. Reinforcing ribs (5*f*) may also be added to the outer surface of the side wall to further increase its rigidity. Further, on the outer periphery of the casing (5), a cover (7) with a reinforcing ring (7*a*) having a close clearance with the casing (5) is slidably mounted. If any outward deforming force is applied, the reinforcing ring (7*a*) with the strong side wall (7*b*) of the cover (7) limits the deformation from occurring, and maintains close contact between the piston (13) and the planar surface (5*a*) on the inner side wall of the casing (5).

FIGS. 12-*a*, 12-*b* and 12-*c* show three shapes for the distributing grooves (20*b*), on the eccentric sleeve (20). Because the distributing grooves (20*b*) are very long, the rigidity of the eccentric sleeve (20) can be seriously weakened. Since the clearance between the cylinder block (14) and the eccentric sleeve (20) is very small, any deformation of the eccentric sleeve (20) will destroy the normal close fit with the cylinder block (14). To solve this problem, improved shapes for the distributing grooves are provided. One or several reinforcing ribs (20*c*) are added to the distributing grooves (20*b*), as shown in FIG. 12, to reduce deformation and increase significantly the mechanical efficiency at high working fluid pressure. In this manner, various distributing grooves for various ranges of working fluid pressure are provided. Similarly, several cross sectional forms for the distributing oil grooves on the periphery of the eccentric (1*a*) of the eccentric shaft (1) are provided, including non-reinforced or with reinforced with ribs (1*c*), for various ranges of working pressure. Irregular wear of the planar surface (5*a*) on the inner side wall of the casing (5) will also destroy the close contact between the planar surface (5*a*) and the piston (13) and lead to an increase of fluid leakage or decrease in volumetric efficiency. To solve this problem, the planar surface (5*a*) is treated with an appropriate wear resistant layer or a wear resistant block (5*c*) is set on it. In addition, the head block of the piston is made with a wear resistant material, as shown in FIGS. 5, 11.

To prevent vibration due to imbalance of rotating parts at high rotational speeds, the casing (5), the cover (7) and the cylinder block (14) are designed with simple outlines which can be precisely and easily cut by machine tools. In this way, the thickness allowance and the amount of the imbalance can be controlled.

The number of the pistons (13) can be selected arbitrarily. However, from the standpoint of uniformity of fluid flow and convenience of manufacture, it is preferably 3, 5, or 7. The cylinders (14*a*) can be arranged in the cylinder block 14 in one or several rows as desired.

Figure 13:
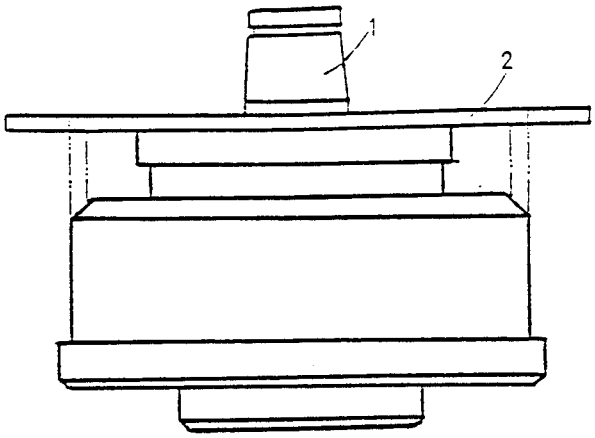
FIG. 13 shows an oil seal cover extended outwardly to form a disk or drum for auxiliary braking.
Figure 14A:
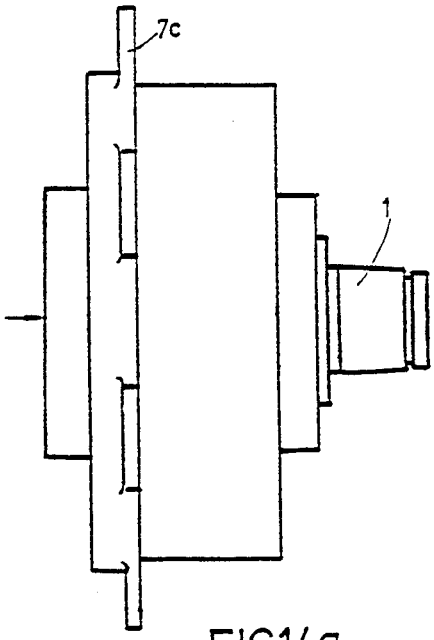
FIG. 14 shows a wheel mounted motor with ear-like connecting means for direct mounting the wheel.
Figure 14B:
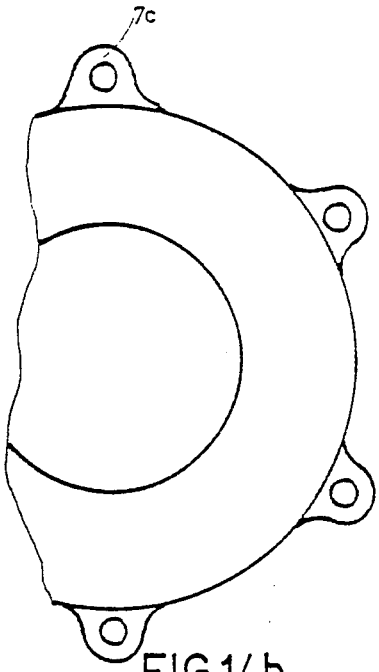

To meet the requirements of additional brakage in wheel mounted motors, an oil seal cover 2 is extended outwardly, as shown in FIG. 13, to form a disk or a drum. For direct mounting of the wheel to motor, the casing (5) or cover (7) are provided with several outwardly extending ear-like connecting means (7*a*) as shown in FIG. 14. Studs may be used.

The continuously variable displacement radial piston device according to the present invention can be modified easily to a fixed displacement radial piston device. The eccentric sleeve (20) and the eccentric shaft (1), forming the combined eccentric is replaced by a single eccentric shaft (1), with a fixed eccentric and the sliding pin (21), the displacement control sleeve (22) and displacement control arm (23) are eliminated. The structure of this kind of radial piston device is simpler and can be used where the requirements for the adjustable range for the rotational speed range is not too wide.

Figures 15, 15D, 15E, 15F:
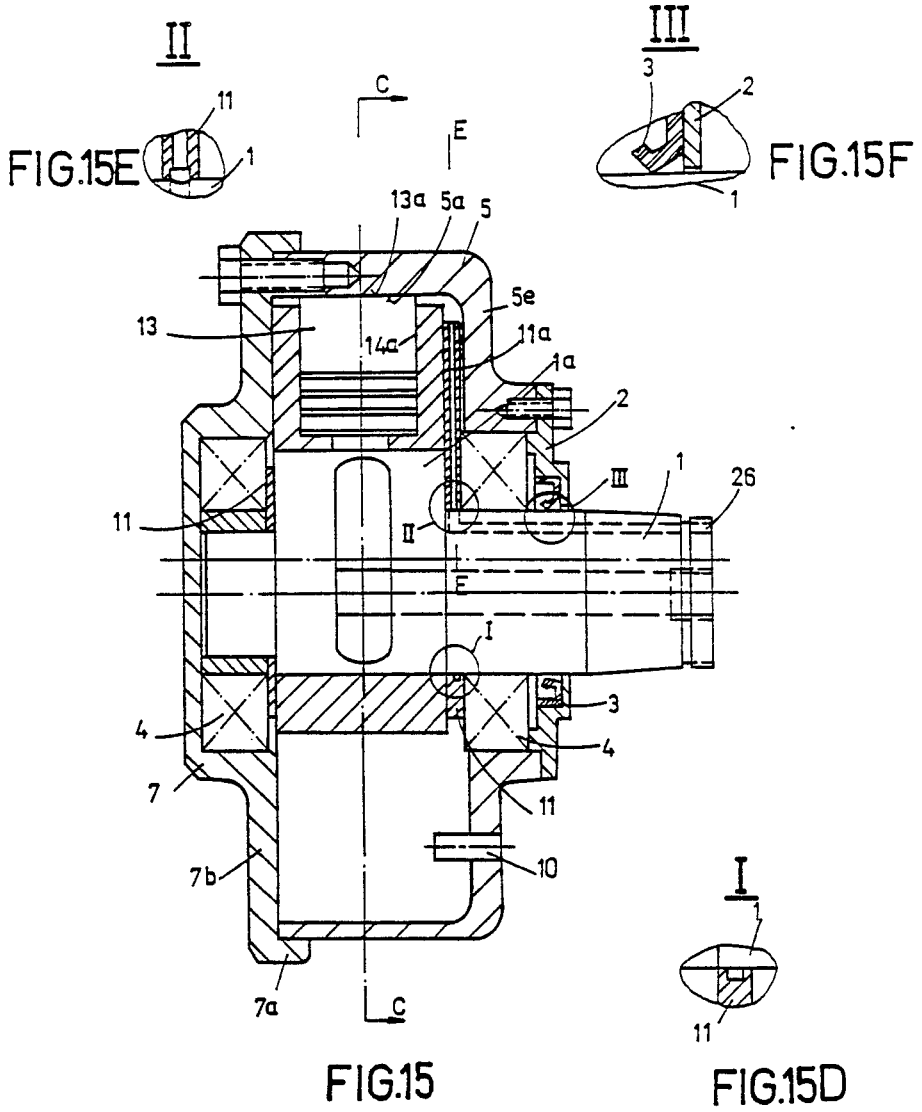
FIG. 15 is an axial section of a fixed displacement pump or motor according to the invention.
Figure 15C:
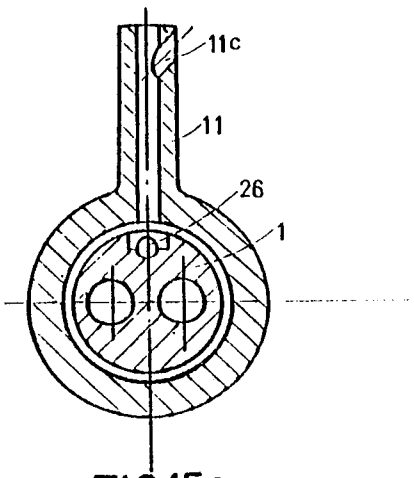
Figure 15B:
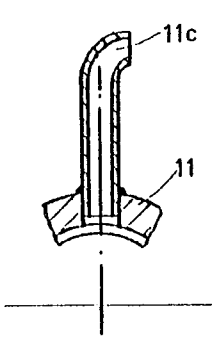
Figure 15A:
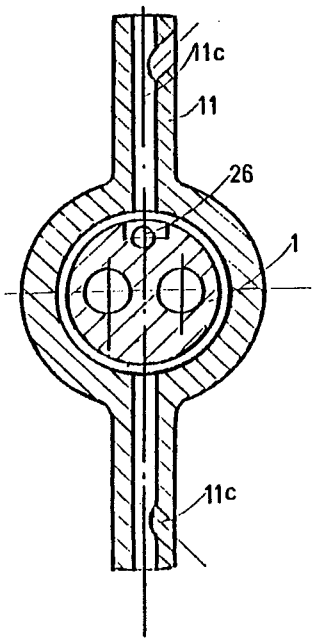
Figure 16:
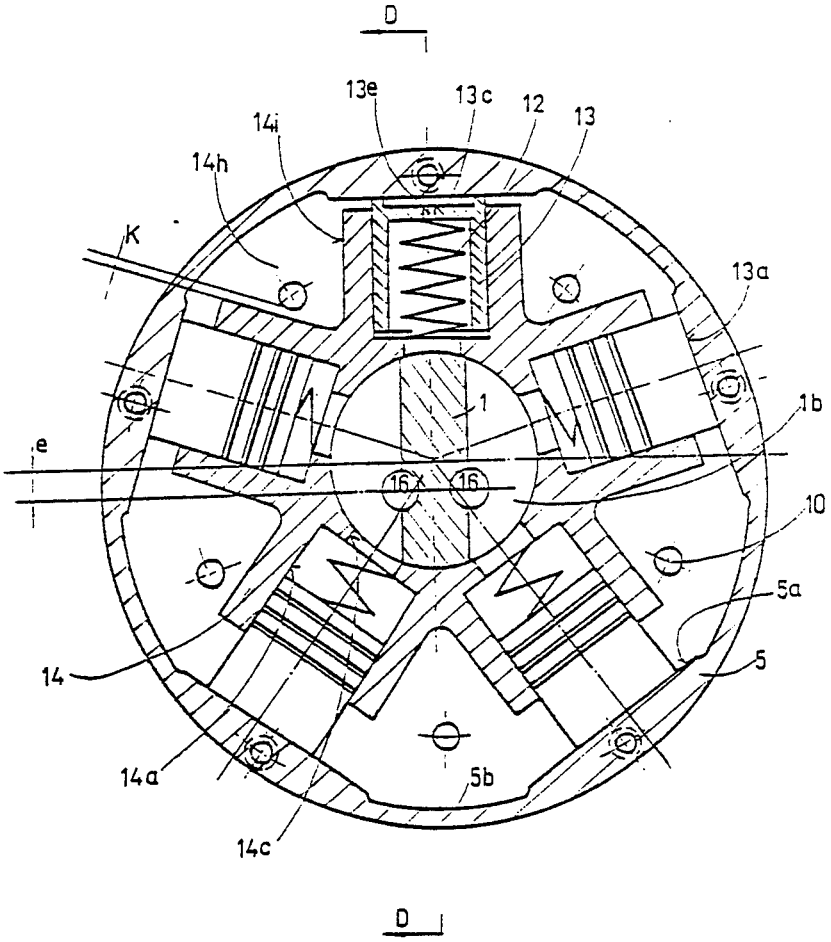
FIG. 16 is a cross-section taken from FIG. 15 along lines C—C.

The structure of a fixed displacement radial piston device is shown in FIGS. 15 and 16. It comprises a circular casing (5), having a bottom and side wall with a plurality of planar surfaces alternating with arcuate sections on the inner side wall; a cover (7) therefor; disposed centrally in the casing (5) and/or cover (7) are two bearings (4) to support an eccentric shaft (1) having a fixed eccentric (1*a*) there between; a cylinder block (14) rotatably mounted on the eccentric (1*a*), the cylinder block (14) having a plurality of cylinders (14*a*) arranged radially with its axis perpendicular to the axis of the eccentric shaft (1), where in each cylinder (14*a*) is slidably fitted with a piston (13) with a flat outer face end (13*a*) and contacting with a planar surface (5*a*) on the inner side wall of the casing (5), and wherein the eccentric shaft (1) having a relative rotary movement to the casing (5), urges the pistons (13) to reciprocatingly slide in the cylinders (14*a*); communicating oil ducts in the eccentric shaft (1), the cylinder block (14) and the pistons (13) are provided through which a process for the intake and exhaust of working oil can be realized; a plurality safety pins (10) usually corresponding to the number of cylinders, are pressed into the side wall (5*e*) of the casing (5) or the cover (7), the outer end of each safety pin (10) extending into the vacant space (14*h*) between adjacent cylinders (14*a*) and having an appropriate clearance (K), to the cylinder wall (14*i*) to allow the cylinder block (14) to rotate slightly in the casing (5), so that during normal running conditions, the safety pins (10) will not interfere with the movement of the cylinder block (14); however, when there is a sudden change in the relative rotating speed between the casing (5) and the cylinder block (14), the change in relative rotating movement causes the safety pins (10) to contact the cylinder wall (14*i*) and limits the amplitude of the relative rotating movement, whereby the pistons (13) can be held in position to prevent movement to the arcuate sections (5*b*) of the casing (5), to guarantee the maintenance of the normal process of the radial piston device. Other improvement stated above for the continuous variable can also be used in the fixed displacement radial piston device. These need not be repeated herein.

As is well known, an oil seal is a key component in hydraulic devices. The usual lip-type oil seal does not provide satisfactory performance, particularly when the pressure of the oil stored in the casing 5 exceeds the external pressure. To solve this problem, a new type of a compact face oil seal consisting of only two parts is provided. As shown in FIG. 17, the face oil seal comprises an elastic seal ring (30), a face seal ring (31) for maintaining close contact with a plane (2*a*) on the oil seal cover (2). The elastic seal ring (30) is mounted on the eccentric shaft and a groove (not shown) on the face seal ring (31) is provided with a relatively large interference to prevent relative angular movement therebetween and oil leakage from the contacting surfaces, as well as to provide sufficient frictional force to permit the face seal ring (31) to slide on the plane (2*a*) of the oil seal cover (2). The elastic seal ring having axial elasticity, is preloaded appropriately to maintain close contact with the plane (2*a*) on the oil seal cover (2). So when the pressure of the oil stored in the casing (5) is higher than the external pressure, the difference in pressure acting upon the elastic seal ring (30) forces the face seal ring (31) to press into the plane (2*a*) of the oil seal cover (2) more closely. In this way, a tight seal is reliably kept. Moreover, the life of the oil seal is lengthened.

The face oil seal above provide is simple and cheap. It can be used widely in all kinds of machines with working fluids, such as a water pump seal for water-cooled internal combustion engines.

What claimed is:

1. A radial piston device usable as a pump or motor comprising:

(A) a casing with a side wall having a plurality of planar surfaces on the inner surface of the side wall;

(B) a cover therefor;

(C) bearings fitted in the central part of the casing and cover;

(D) an eccentric shaft with an eccentric supported between the bearings, said eccentric shaft having two separate groups of fluid ducts disposed therein and fluid distributing means communicating therewith for conducting a fluid, one group of the fluid ducts being connected to a high pressure fluid system and the other group of fluid ducts to a low pressure fluid system;

(E) a cylinder block rotatably mounted on the outer periphery of the eccentric, said cylinder block having a plurality of cylinders corresponding to the plurality of planar surfaces in the casing, radially arranged in a plane perpendicular to the axis of the eccentric and eccentric shaft;

(F) a sliding piston fitted in each of the cylinders, each piston having an outer flat end face contacting a planar surface in the casing, whereby when said eccentric is provided with rotary movement relative to the casing, the eccentric will urge the pistons to reciprocatingly slide in the cylinders in turn;

(G) a plurality of return springs positioned between the pistons and the cylinder block urgingly holding the pistons against the planar surfaces in the casing; wherein the eccentric of the eccentric shaft is a combined eccentric consisting of an eccentric shaft and an eccentric sleeve with a bore and two separate arcuate fluid distributing grooves communicating respectively with the two separate groups of fluid ducts in the eccentric shaft and with the cylinders in the cylinder block in turn to work as a distributing valve, the eccentric sleeve being rotatably mounted on the eccentric shaft through its bore and with the cylinder block mounted in the outer periphery thereof, the dimension of the combined eccentric being adjustable continuously by controlling the relative angular position of said eccentric sleeve to said eccentric shaft to adjust the displacement of the radial piston device continuously.

2. A radial piston device as claimed in claim 1 wherein the eccentric sleeve further contains a sliding pin hole in its side face, in which a sliding pin is fitted slidably, said sliding pin having two slide planes on its outside end and extending to a slide groove in a displacement control sleeve, said displacement control sleeve being slidably and rotatably mounted on said eccentric shaft, the outer periphery of said displacement control sleeve being fitably pressed into the inner ring of the bearing in the casing or the cover and having teeth on the outside face of said displacement control sleeve connected to an outside control mechanism whereby a sufficient torque may be applied to the displacement control sleeve to rotate it relative to the eccentric shaft and transmitted via the slide groove and slide pin to the eccentric sleeve urging the eccentric sleeve to produce a relative rotary movement to said eccentric to adjust the dimension of the combined eccentric continuously.

3. A radial piston device as claimed in claim 2 further comprising a displacement control arm having teeth means to engage with the teeth on the displacement control sleeve and coaxially mounted with a sliding fit on the eccentric shaft externally to the displacement control sleeve, and further connected with an external displacement control means to control the displacement of the radial piston device.

4. A radial piston device as claimed in claim 2, in which a spoon-like fluid duct having an inner end and an outer end is arranged in said displacement control sleeve and communicating with a leakage fluid duct arranged in the eccentric shaft control sleeve, the outer end of said spoon-like fluid duct extending radially as far as possible in the casing to use the dynamic pressure and inertia of the leakage fluid stored in the casing to force the leakage fluid out into an outer fluid reservoir via the spoon-like fluid duct and the fluid leakage duct in the eccentric shaft.

5. A radial piston device as claimed in claim 1 wherein safety pins are pressed into the side wall of the casing or the cover, the outer end of said safety pin extending into the space between adjacent cylinders of said cylinder block and having an appropriate clearance to the cylinder wall to allow the cylinder block to rotate slightly relative to the casing but at the same time limiting the amplitude of said relative rotational movement during sudden changes in the relative rotational speed of the casing to the cylinder block.

6. A radial piston device according to claim 1, in which the casing is constructed integrally with a strong, rigid side wall and additional reinforcing ribs on its outer surface.

7. A radial piston device according to claim 1 wherein the planar surfaces in the casing are coated with a wear resistant material.

8. A radial piston device according to claim 1 wherein the surfaces on the piston outer end faces are provided with a wear resistant material.

9. A radial piston device as claimed in claim 1 wherein the cover is provided with a reinforcing ring slidably mounted with close clearance on the outer periphery of the casing to use the strong side wall of the cover to restrict deformation of the casing on the side of the cover.

10. A radial piston device as claimed in claim 1 wherein the cylinder bore is in a stepped form, with the bore of an outer portion of the cylinder having a larger diameter and the bore of an inner portion of the cylinder having a smaller diameter and an oval cross section, and with the inner portion positioned toward the eccentric shaft.

11. A radial piston device according to claim 1, wherein the cross section of the fluid ducts within the eccentric shaft is selected from cylindrical, paired cylindrical, or kidney shaped forms.

12. A radial piston device according to claim 1 wherein the distributing grooves on the eccentric sleeve are provided with at least one reinforcing rib.

13. A radial piston device according to claim 1, wherein a fluid recess is arranged coaxially in the end face of the pistons, communicating with the fluid duct through a throttle hole, said fluid recess having a reticular form.

14. A radial piston device according to claim 1, wherein a fluid recess is arranged coaxially in the end face of the pistons, communicating with the fluid duct through a throttle hole, said fluid recess having a non-reticular form.

15. A radial piston device according to claim 1, wherein the number of pistons is an odd number.

16. A radial piston device used as a motor according to claim 1, wherein a fluid sealing cover is in the form of a disk or a drum and wherein a plurality of ear-like connecting means are provided on the casing or cover for mounting a wheel directly to said casing or cover.

17. A radial piston device as claimed in claim 1, wherein the fluid is an oil.

* * * * *